US011324312B2

(12) United States Patent
Bradley

(10) Patent No.: US 11,324,312 B2
(45) Date of Patent: May 10, 2022

(54) DECORATIVE TABLE

(71) Applicant: Laura Bradley, Lunenburg, MA (US)

(72) Inventor: Laura Bradley, Lunenburg, MA (US)

( * ) Notice: Subject to any disclaimer, the term of this patent is extended or adjusted under 35 U.S.C. 154(b) by 0 days.

(21) Appl. No.: 16/985,923

(22) Filed: Aug. 5, 2020

(65) Prior Publication Data

US 2022/0039549 A1 Feb. 10, 2022

(51) Int. Cl.

| | |
|---|---|
| ***A47B 13/08*** | (2006.01) |
| ***A47G 33/12*** | (2006.01) |
| ***A47B 9/14*** | (2006.01) |
| ***A47B 3/083*** | (2006.01) |

(52) U.S. Cl.

CPC ..... *A47B 13/088* (2013.01); *A47B 3/083* (2013.01); *A47B 9/14* (2013.01); *A47G 33/12* (2013.01); *A47B 2220/0008* (2013.01)

(58) Field of Classification Search

CPC ..... A47B 13/088; A47B 2220/0008; A47G 33/12

USPC ..... 108/94, 50.12, 66, 127

See application file for complete search history.

(56) References Cited

U.S. PATENT DOCUMENTS 570,403 A * 10/1896 Hunt et al. ..... A47F 7/08 211/36
1,302,321 A * 4/1919 Daniel ..... B62K 3/002 280/87.05
1,890,409 A * 12/1932 Roberts ..... A47B 3/087 108/35
1,943,659 A * 1/1934 Eason ..... A47G 33/126 47/40.5
2,024,431 A * 12/1935 Corduan ..... A47B 3/0916 108/127
2,454,202 A 11/1948 Pierik
2,782,085 A 2/1957 Natale
2,977,169 A * 3/1961 Geller ..... A47B 9/16 108/19
3,049,387 A * 8/1962 Schlegel ..... A47B 3/087 108/166
3,058,707 A 10/1962 Lego
4,383,487 A * 5/1983 Fitzner ..... A47F 5/04 108/150
4,718,630 A * 1/1988 Richard ..... A47B 23/007 108/1
4,734,301 A * 3/1988 McKinney ..... A41G 1/007 211/196
D309,682 S * 8/1990 Fisher ..... D6/357
5,131,618 A 7/1992 Chapin
5,367,962 A * 11/1994 Tseng ..... A47B 3/0812 108/127
5,523,130 A 6/1996 Sullivan
(Continued)

FOREIGN PATENT DOCUMENTS

EP 0943273 9/1999
FR 2842086 A1 * 1/2004 ..... A47B 13/088
WO 03056983 7/2003

*Primary Examiner* — Jose V Chen
(74) *Attorney, Agent, or Firm* — Lambert Shortell & Connaughton; David J. Connaughton, Jr.; Justin P. Tinger

(57) ABSTRACT

A table is provided. The table defines a cutout region such that the table may be placed closely to a tree trunk or other upright element, with the table partially surrounding the element via the cutout region. The table may be particularly useful to provide enhanced decorative ability for decorative Christmas displays, decorative store displays, and the like.

14 Claims, 4 Drawing Sheets

(56) References Cited

U.S. PATENT DOCUMENTS 5,577,448 A * 11/1996 Leung ..... A47G 33/0809 104/125
5,577,701 A 11/1996 Plzak
5,911,633 A 6/1999 Sofy
6,155,529 A 12/2000 De Carlo
6,347,591 B1 * 2/2002 Karpa ..... A47B 37/00 108/25
6,477,966 B1 11/2002 Petryna
6,688,239 B1 2/2004 Pettini
6,889,618 B1 * 5/2005 Gromack ..... A47B 13/088 108/151
7,296,522 B1 * 11/2007 Mahmalji ..... A47B 37/04 108/50.13
7,322,300 B2 * 1/2008 Caeton ..... A47B 13/088 108/50.12
7,597,304 B1 10/2009 Gray
8,196,530 B1 6/2012 Van Dyk
8,276,524 B2 * 10/2012 Goode ..... A47G 19/00 108/94
8,397,648 B1 * 3/2013 Palladino ..... A47B 37/04 108/42
8,640,894 B1 * 2/2014 Cronin ..... A47B 97/00 211/205
8,720,349 B1 * 5/2014 David ..... A47B 37/04 108/50.12
8,776,431 B1 * 7/2014 Wiseman ..... A47G 7/02 47/39
9,210,998 B2 * 12/2015 Kadosh ..... A47B 13/088
10,767,385 B2 * 9/2020 Wehr ..... E04H 12/2215
2006/0260516 A1 * 11/2006 Chow ..... A61G 13/105 108/14
2010/0163086 A1 * 7/2010 Chavez ..... A45B 3/00 135/16
2019/0029454 A1 1/2019 Gariti

* cited by examiner

DECORATIVE TABLE

BACKGROUND

Technical Field

The present disclosure relates generally to tables. More particularly the present disclosure relates to a table which can be positioned adjacent to a Christmas tree or similar upright element to provide enhanced decoration and display of items on and around the table.

Description of Related Art

Christmas decorations, as well as other seasonal and general decorations often revolve around trees or other upright columns or elements. Many times, these items can be difficult to decorate or suffer from the same old decorative patterns that have been used for generations. For example, Christmas trees have been decorated with ornaments, tinsel, garland and lights in more or less the same manner for hundreds of years. Similarly, columns and other displays arranged around an upright element are generally limited to wrapping about the upright. While there is nostalgic charm in this, new and engaging ways to decorate a tree and other upright element will provide a substantial benefit.

Therefore, what is needed is a display element which can be positioned adjacent to a tree and potentially engage with the tree.

SUMMARY

The subject matter of this application may involve, in some cases, interrelated products, alternative solutions to a particular problem, and/or a plurality of different uses of a single system or article.

In one aspect, a table is provided. The table has a table top which defines a cutout region. This cutout region is sized and shaped to be able to fit around an upright element such as, among other options, the trunk of a Christmas tree. A plurality of legs depend down from the table top and elevate it off the ground. As such, the table can be closely positioned around at least part of the upright element, and can hold decorations on the table top surface, edges, legs, and other parts, to provide an exciting, integrated decorative display.

In another aspect, a table and tree assembly is provided. The table has a table top which defines a cutout region. A plurality of legs depend down from the table top and elevate it off the ground. A trunk of the tree, such as a Christmas tree, is positioned in the space defined by the cutout region such that the table is able to partially surround the tree. Decorations may then be placed on the table top and integrated into the decoration of the Christmas tree as a whole. In certain embodiments which surround and/or are attachable to the tree trunk, the table may also operate as a Christmas tree stand, supporting the trunk in an upright position and providing stability to it. Therefore, the table may have a secondary function as a tree stand, eliminating the need for traditional tree stands. Of course in other embodiments, both the table and tree stand may be employed together.

In yet another aspect, a method of positioning a table adjacent to a tree such as a Christmas tree is provided. The method begins with removing a plurality of branches from the tree. A table is then placed adjacent to a trunk of the tree. The trunk of the tree is at least partially within the area defined by the cutout region. The table has a table top which defines a cutout region, and a plurality of legs which depend down from the table top and elevate it off the ground. The table is attached to the tree by securing a connector of the table top such as a strap, clamp, chain, belt, and the like, around the trunk of the tree. A decoration or decorations may be placed on the table top to improve the decorative design of the tree as a whole.

DETAILED DESCRIPTION

Figure 1:
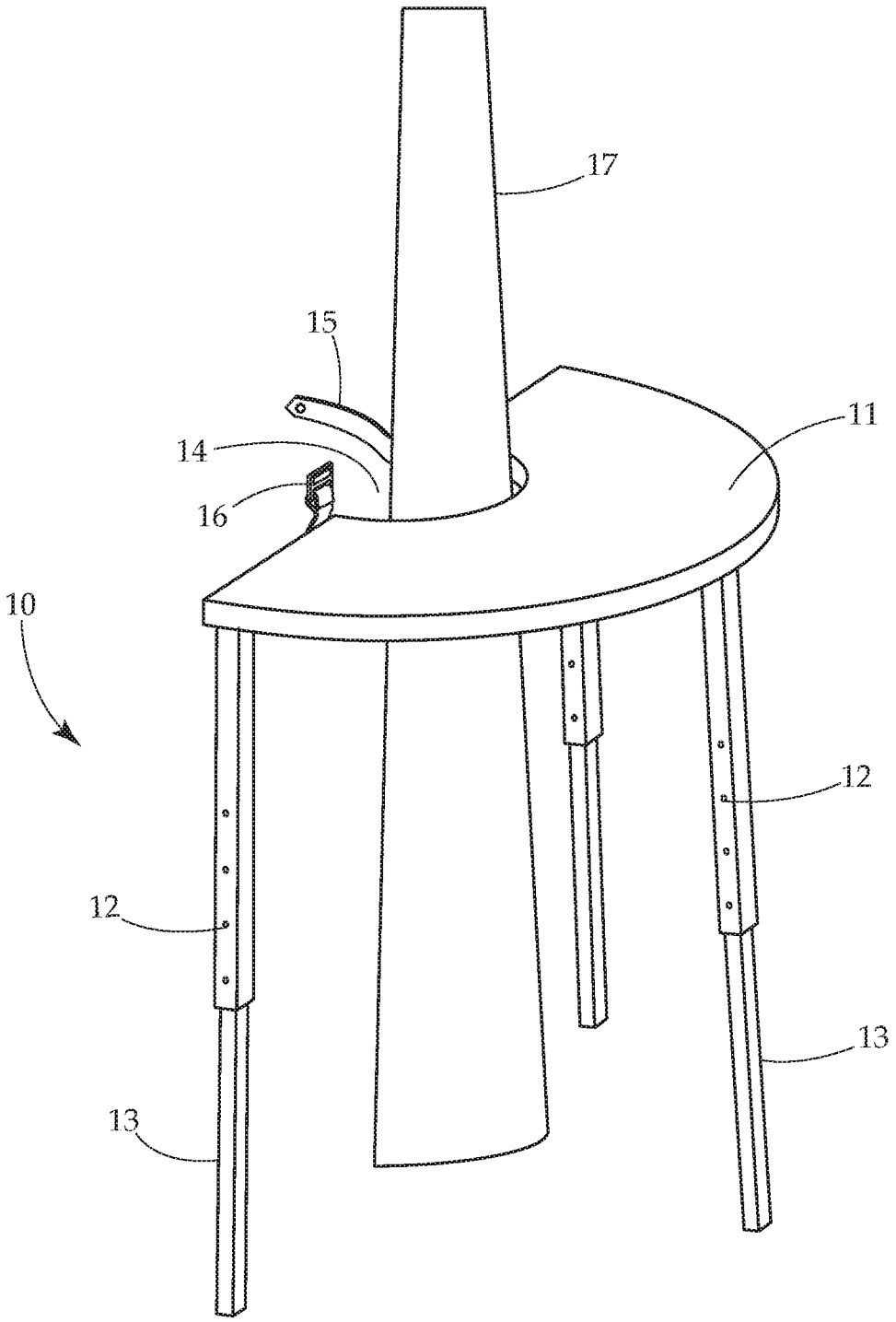
FIG. 1 provides a perspective view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

Generally, the present disclosure concerns a table with a cutout region allowing it to be placed adjacent to, for example, a Christmas tree or other upright element (column, shaft, post, tree trunk, and the like). In many embodiments, the table is formed as a shape, such as a semi-circle, having one elongate flat side. Of course, other shapes of the cutout may be used, and the cutout region may be on other parts of the table perimeter. In one embodiment, the cutout region is formed on this flat side, a cutout region is formed to accommodate the tree trunk or upright element, allowing the table to be placed closely adjacent to and at least partially surrounding the upright element. On or more legs, typically three, extend downward from the table to support it off the ground. In many embodiments the leg(s) are foldable and extendable by, for example, a telescoping configuration. Certain embodiments include rubber feet on the ends of the legs. As such, decorations can be placed on the table or connected thereto, to provide an innovative and exciting new way to decorate.

In many embodiments, the cutout region has a same shape as an outer edge of the table. For example a semicircular table may have a semicircular cutout region. This is not necessarily required, of course. In further embodiments, the cutout region may have a same shape as both an outer edge of the table and also as the shape of the upright element it is intended to be positioned against. For example if the table is intended to be positioned adjacent to a tree trunk such as a Christmas tree trunk, the roughly circular tree trunk may match a semicircular cutout region which in turn may match a semicircular perimeter of the table. This embodiment may provide a consistent and pleasing appearance so that the profiles of the upright (trunk or other) aligns with the table itself, providing a uniform and consistent profile which is known to be pleasing to the eye.

The table may be enhanced by including various features. For example, a strap or other connector may be connected to span the cutout region. The strap can be connected and released around the tree trunk or other upright element that the table is placed adjacent to, so as to secure the table in place. In other embodiments, an additional table top part having its own cutout region may be connected to the table, to enclose the tree/upright element. The additional table top may connect to the elongate flat side of the primary table top in any manner to expand the table. For example, it may have a hinged connection at one end of the elongate flat side, may be connectable by a slide bracket for a sliding engagement, or other interlocking part connection such as snap connection, a pin/shaft connection, male female engagement, frictional connection, dovetail connection, and the like.

In other embodiments, a second table top may rest a top of the table on or be connected to the table's top surface. This second table top also has a cutout region which aligns approximately or is smaller than the table's cutout region. As such, the table and second table top may both be placed at least partly around the tree. In some cases, a skirt may be placed on the top of the table to drape down to create a pleasant decorative effect. In yet another embodiment, the table may have a lower shelf below the table which may be particularly useful for storing and displaying presents instead of placing them on the ground below the tree.

Examples of some types of decorations which may be positioned on the table include Christmas decorations, a nativity scene, a Christmas village scene (comprising decorative building models), and the like, as well a stockings (filled and/or unfilled), garlands, tinsel, table skirts, table cloths, and so forth.

In some embodiments, the table may be placed adjacent to a natural Christmas tree having certain branches removed to allow the table to fit more closely to a trunk of the tree. In other embodiments, the table may be placed adjacent to an artificial tree which may have a spacer and/or or may have the artificial branches removed to allow the table to fit more closely to the artificial trunk of the tree.

Turning now to FIG. 1, an embodiment of the table of this disclosure is shown. The table 10 has a table top 11 with an elongate flat side which can be placed adjacent to a tree trunk 17 or other upright element. In this embodiment, the table top 11 is a semicircular table. A cutout region 14 is formed along the elongate flat side of the semicircle. The cutout region 14 is also semicircular but need not necessarily be so. A strap 15 and clasp 16 can be connected together around the trunk 17 to hold the table 10 in place. Three legs 13 depend from the bottom of table top 11. These legs 13 can extend and retract in length by, in this embodiment, a pin engaging with holes 12. Once positioned and attached, the table 10 can then be used as a base for decorations with items resting on the table top 11 and attached to the other parts of the table 10.

Figure 2:
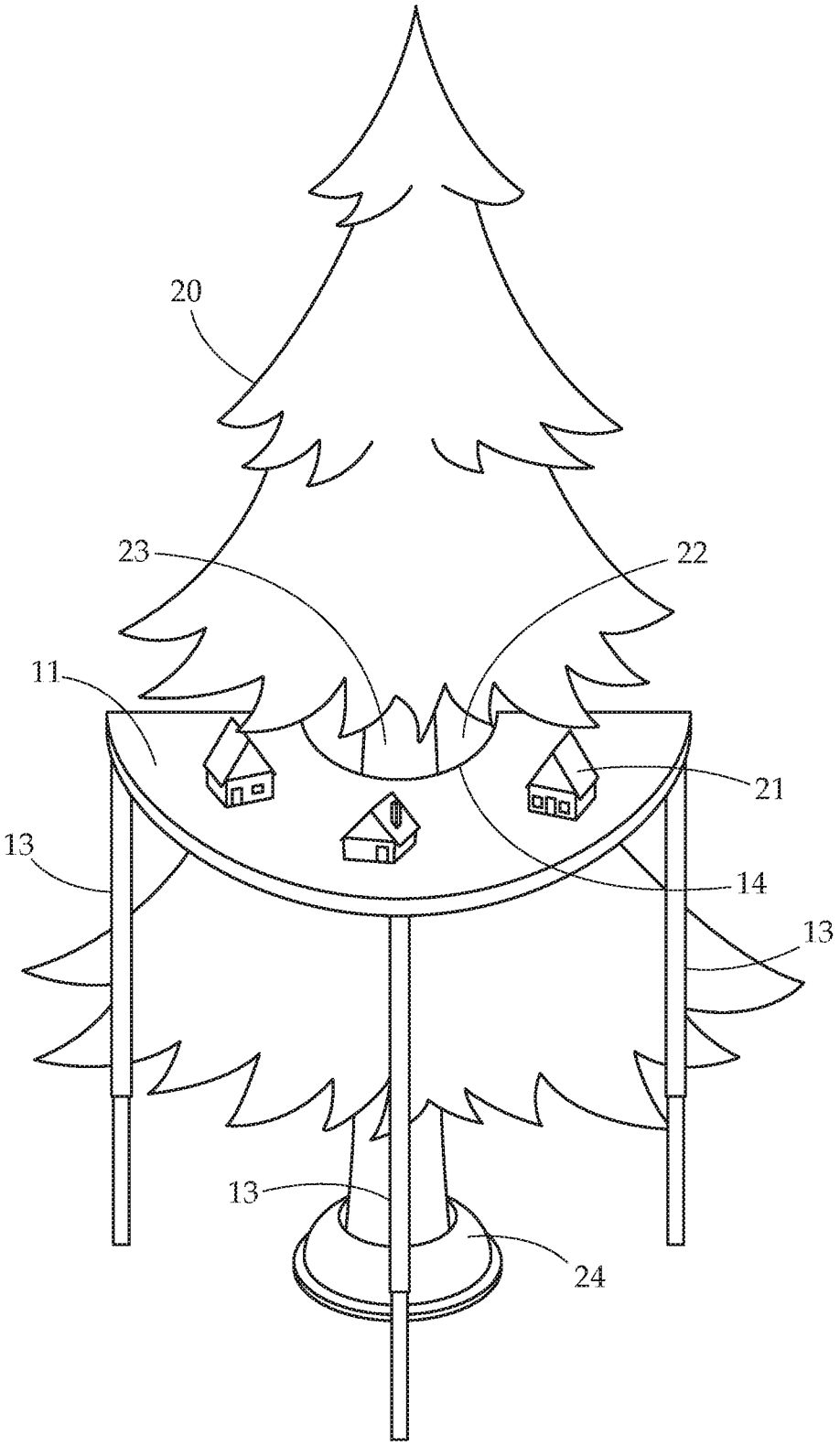
FIG. 2 provides a perspective view of another embodiment of the present disclosure positioned adjacent to a Christmas tree.

FIG. 2 shows another embodiment of the disclosed table. Here, the table 10 is positioned adjacent to a Christmas tree 20. In this view, the tree 20 has had branches trimmed, cut, or otherwise removed, about trunk 23 forming an open area 22. The table top 11 fits into this open area 22, allowing the table cutout region 14 to fit closely to or against the tree 20. This also allows the table to be less visually intrusive and appear to be more integral with the tree 20. The tree is supported by Christmas tree stand 24. On the table are decorations 21, in this case a Christmas village scene.

Figure 3:
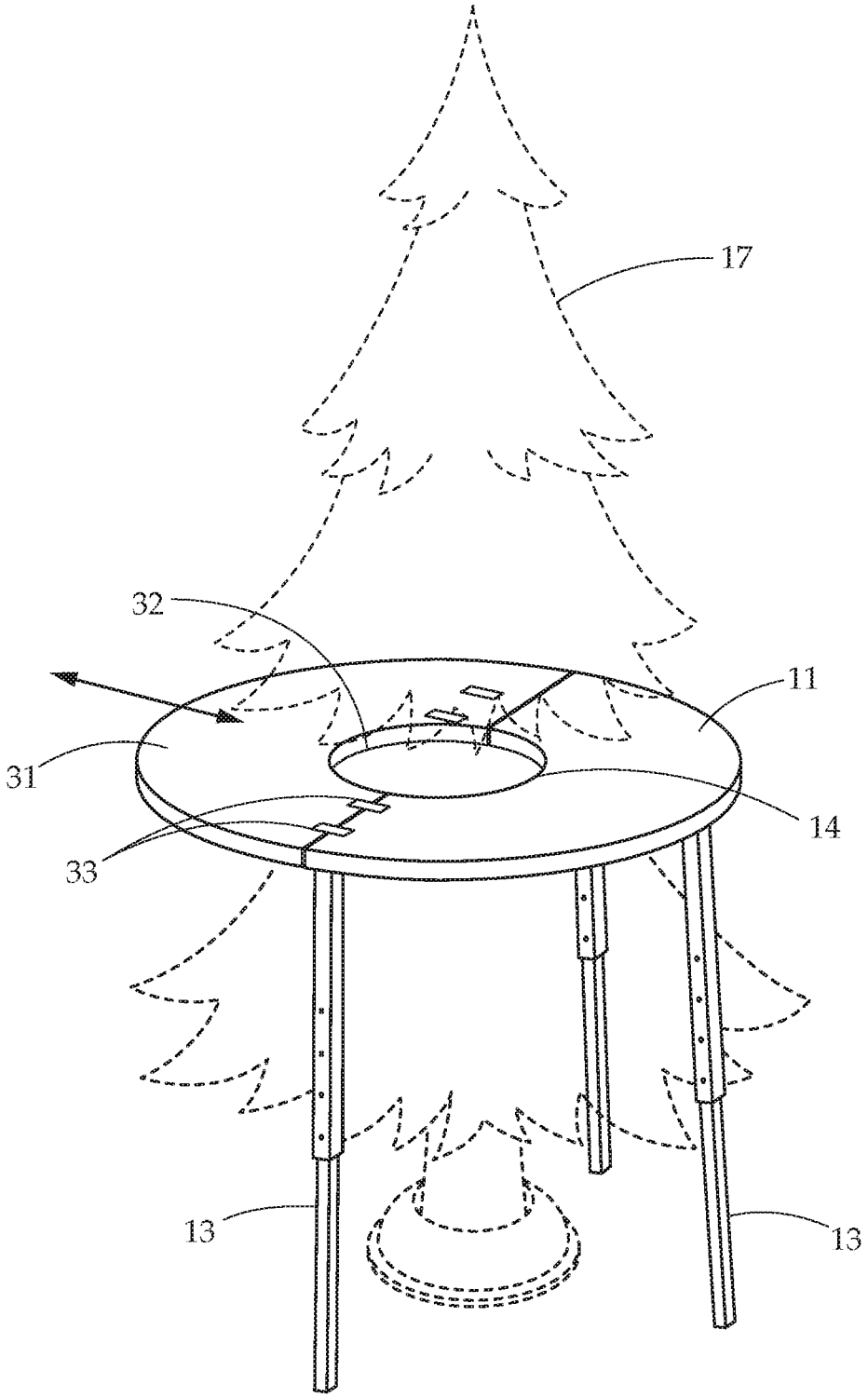
FIG. 3 provides a perspective view of yet another embodiment of the present disclosure positioned adjacent to a Christmas tree.

FIG. 3 provides a view of an embodiment of a table having an additional table top 31 attached thereto so as to surround a Christmas tree trunk. In this view, an additional table top 31 is connected to the table top 11 by interlocking connectors 33. The additional table top 31 is slidable in and out as shown by the arrow to connect and remove the additional table top 31 with the table top 11. The additional table top 31, in this view, has top surface which is aligned with a top surface of the table top 11. In another similar embodiment, the top surface of the additional table top 31 may be in the same plane as the top surface of the table top 11. Of course, other connection methods are possible without straying from the scope of this invention. Additional table top 31 has its own cutout region 32 to accommodate the trunk 17 of the Christmas tree. In one embodiment, the additional table top 31 does not have any legs and is supported by the table 10. In such an embodiment, it may be desirable to face the additional table top 31 to the front of the tree, which allows the additional table top 31 to "float" and not have legs in the front which may interfere with the visual appearance of presents under the tree.

Figure 4:
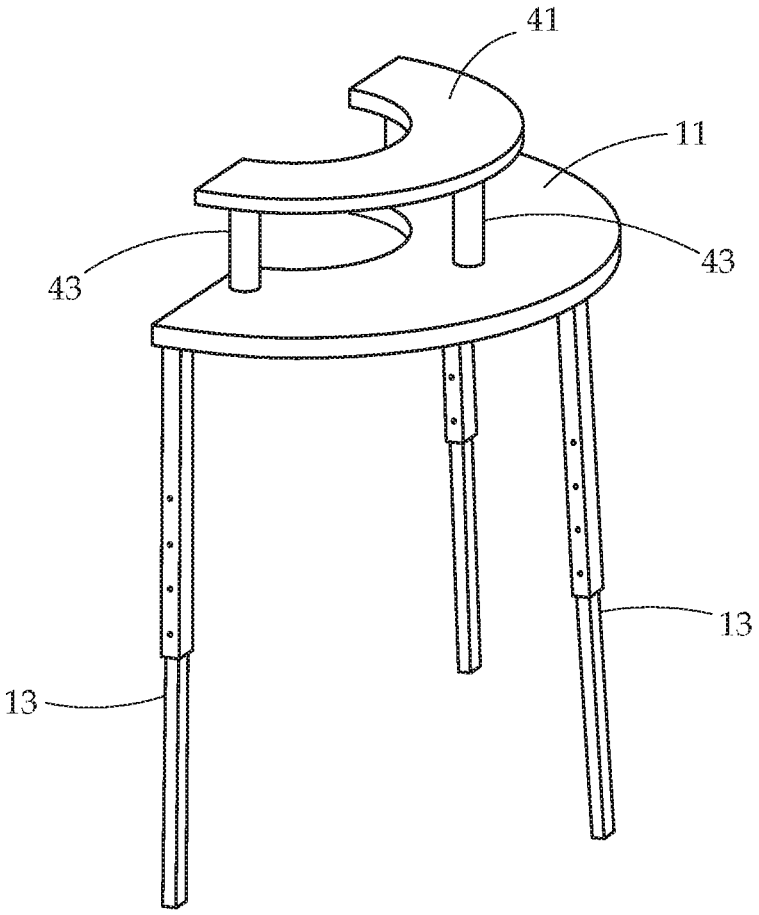
FIG. 4 provides a perspective view of an embodiment of the present table disclosure having two levels.

FIG. 4 provides a view of the table having two levels. In this view, a second table 41 is positioned on table top 11 and elevated by legs 43. The second table 41 of the embodiment shown is smaller than the table top so as to create an often-desirable tiered appearance for decorations. The second table 41 has a table top which defines a cutout region. This cutout region of the second table 41 is vertically aligned with the cutout region 14 so that both tables can be positioned partially around an upright element such as a column, Christmas tree trunk, and the like. Legs 43 of the second table 41 may be connected to the table top 11 by, for example, a structural engagement connection such has fitting in to grooves or pins, or other interfacing and/or interlocking arrangements, magnets, adhesive, and the like. Or, the legs 43 may simply rest on the table in other embodiments.

Figure 5:
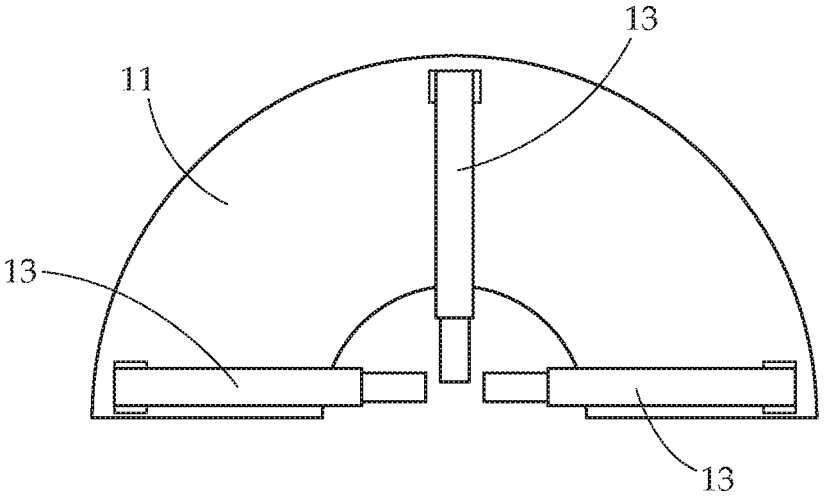
FIG. 5 provides an elevation view of a bottom of an embodiment of the disclosed table having legs folded downward.

FIG. 5 shows a view of a bottom of the table having folded legs. In this view, the bottom of the table top 11 is seen. Legs 13 attached to the table top 11 via brackets are folded inward. The leg length is retracted as much as possible and the legs fold inward, so as not to extend beyond the perimeter of the table top 11.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A table comprising:

a table top defining a cutout region, the cutout region sized and shaped to at least partially receive an upright element;

a plurality of legs connected to a bottom of the table top, wherein the plurality of legs are foldable and telescoping to allow for an adjustable height of the table top;

wherein each one of the plurality of legs comprises a pin and a plurality of holes, wherein the plurality of legs are telescoping to allow for an adjustable height of the table top by the pin on each one of the plurality of legs engaging with one of the plurality of holes on each one of the plurality of legs;

an additional table top, the additional table top connected to a side of the table top which defines the cutout region, a top surface of the additional table top being aligned with a top surface of the table top, the additional table top comprising a second cutout region aligned with the cutout region; and wherein the table top is supported only by the plurality of legs attached to the bottom of the table top, and the additional table top is supported only by its connection to the table top.

2. The table of claim 1 wherein the table top is formed having a semicircular shape, and wherein the cutout region has a semicircular shape formed along an elongate flat edge of the semicircular table top.

3. The table of claim 1 wherein the cutout region is sized to receive a trunk of a Christmas tree.

4. The table of claim 1 further comprising a second table positioned on a top of the table top, the second table comprising a second table top which defines a second cutout region, the second cutout region aligned vertically with the cutout region of the table top.

5. The table of claim 1 wherein the second table top comprises a plurality of second legs, a distal end of each of the plurality of second legs being engaged with the table top by an structural engagement.

6. The table of claim 1 wherein the additional table top is removably connected to the table top by a sliding engagement between interlocking connectors of the additional table top and table top.

7. A table and tree assembly comprising:

a table comprising:

a table top defining a cutout region, the cutout region sized and shaped to at least partially receive a trunk of a tree;

a plurality of legs connected to a bottom of the table top, wherein the plurality of legs are foldable and telescoping to allow for an adjustable height of the table top;

wherein each one of the plurality of legs comprises a pin and a plurality of holes, wherein the plurality of legs are telescoping to allow for an adjustable height of the table top by the pin on each one of the plurality of legs engaging with one of the plurality of holes on each one of the plurality of legs;

the tree trunk positioned within a space defined by the cutout region, such that the table top partially surrounds the tree trunk;

an additional table top, the additional table top connected to a side of the table top which defines the cutout region, a top surface of the additional table top being aligned with a top surface of the table top, the additional table top comprising a second cutout region aligned with the cutout region; and wherein the table top is supported only by the plurality of legs attached to the bottom of the table top, and the additional table top is supported only by its connection to the table top.

8. The table and tree assembly of claim 7 further comprising a decoration positioned on a top of the table top.

9. The table and tree assembly of claim 7 wherein the table top further comprising a strap connected across a span defined by the cutout region and around the trunk of the tree, thereby securing the table to the tree.

10. The table and tree assembly of claim 9 further comprising a clasp connected to the table top, wherein the strap is connectable to the clasp across the span defined by the cutout region.

11. The table and tree assembly of claim 7 wherein the tree has a plurality of branches removed adjacent to the table top, allowing the table top to fit closely to the trunk without an interference from branches of the tree.

12. The table and tree assembly of claim 7 further comprising a second table positioned on a top of the table top, the second table comprising a second table top which defines a second cutout region, the second cutout region aligned vertically with the cutout region of the table top.

13. The table and tree assembly of claim 12 wherein the second table top comprises a plurality of second legs, a distal end of each of the plurality of second legs being engaged with the table top by a structural engagement.

14. The table and tree assembly of claim 12 wherein the additional table top is connected to the table top by one of a sliding engagement between interlocking parts of the additional table top and table top or by a hinged connection.

* * * * *